US009951584B2

(12) United States Patent
Nault et al.

(10) Patent No.: US 9,951,584 B2
(45) Date of Patent: Apr. 24, 2018

(54) SEGMENTED GUIDE FUNNEL

(71) Applicant: Cameron International Corporation, Houston, TX (US)

(72) Inventors: Chris Nault, Houston, TX (US); Kevin Shahrpass, Houston, TX (US); Joshua Williams, Richmond, TX (US); Ray Cummins, Houston, TX (US)

(73) Assignee: Cameron International Corporation, Houston, TX (US)

( * ) Notice: Subject to any disclaimer, the term of this patent is extended or adjusted under 35 U.S.C. 154(b) by 1 day.

(21) Appl. No.: 14/974,955

(22) Filed: Dec. 18, 2015

(65) Prior Publication Data

US 2017/0175491 A1 Jun. 22, 2017

(51) Int. Cl.

| | |
|---|---|
| ***E21B 41/08*** | (2006.01) |
| ***E21B 41/00*** | (2006.01) |
| ***E21B 33/064*** | (2006.01) |
| ***E21B 33/038*** | (2006.01) |

(52) U.S. Cl.

CPC ..... *E21B 41/08* (2013.01); *E21B 33/038* (2013.01); *E21B 33/064* (2013.01); *E21B 41/0014* (2013.01)

(58) Field of Classification Search

CPC .... E21B 41/08; E21B 41/0014; E21B 33/038; E21B 33/064

See application file for complete search history.

(56) References Cited

U.S. PATENT DOCUMENTS

| | | | | | |
|---|---|---|---|---|---|
| 1,388,217 | A * | 8/1921 | Thomas | H01B 17/40 | 174/192 |
| 2,165,947 | A * | 7/1939 | Stuck | B02C 2/10 | 241/299 |
| 3,259,191 | A * | 7/1966 | McClintcck | E21B 33/035 | 166/340 |
| 4,098,333 | A * | 7/1978 | Wells | E21B 17/012 | 166/352 |
| 4,347,012 | A * | 8/1982 | Glidden | B63B 21/50 | 114/230.2 |
| 4,477,105 | A * | 10/1984 | Wittman | F16L 27/04 | 285/18 |
| 4,541,755 | A * | 9/1985 | Castel | E21B 7/128 | 166/341 |
| 4,797,029 | A * | 1/1989 | Cowan | E21B 7/043 | 166/338 |
| 4,892,495 | A * | 1/1990 | Svensen | B63B 21/508 | 114/230.12 |

(Continued)

*Primary Examiner* — Matthew R Buck
*Assistant Examiner* — Aaron L Lembo
(74) *Attorney, Agent, or Firm* — Helene Raybaud

(57) ABSTRACT

A guide funnel includes segments that have a funnel surface running at an oblique angle between a bottom end and an inner circumferential edge of the top end. The width of the funnel surface is sized so that, when the guide funnel is in an assembled state, a continuous or discontinuous funnel wall is formed between adjacent segments. The bottom end can include an arcuate-shaped ring segment that forms a portion of an outer periphery of the guide funnel. The top end can be sized so that when the guide funnel is in the assembled state a side of the top end abuts a side of an adjacent top end. An adaptor ring can be secured to the inner circumferential edge of the top end and later removed and replaced with another adaptor ring to provide a different size guide funnel.

19 Claims, 10 Drawing Sheets

(56) References Cited

U.S. PATENT DOCUMENTS 5,174,095 A * 12/1992 Fujiwara ..... B65B 25/148 53/211
5,255,745 A * 10/1993 Czyrek ..... E21B 43/013 166/341
5,273,376 A * 12/1993 Ritter, Jr. ..... E21B 33/038 405/169
5,468,166 A * 11/1995 Breivik ..... B63B 22/026 114/230.1
6,113,314 A * 9/2000 Campbell ..... B63B 21/502 166/339
6,155,193 A * 12/2000 Syvertsen ..... B67D 9/00 114/230.12
6,422,791 B1 * 7/2002 Pallini, Jr. ..... E21B 17/017 166/355
6,503,022 B1 * 1/2003 Nuss ..... B63B 19/00 114/201 R
6,766,861 B2 * 7/2004 Koen ..... E21B 33/035 166/345
7,013,824 B2 * 3/2006 Otten ..... B63B 21/502 114/264
7,341,320 B2 * 3/2008 Otsuka ..... B60T 8/3615 303/119.2
7,510,452 B2 * 3/2009 Van Tol ..... B63B 21/508 441/5
7,614,927 B2 * 11/2009 Olsen ..... B63B 22/023 441/5
7,823,943 B2 * 11/2010 Borg ..... B65D 71/50 294/87.2
7,958,835 B2 * 6/2011 Srinivasan ..... B63B 35/44 114/125
7,967,065 B2 * 6/2011 Lutgring ..... E21B 17/1028 166/241.6
7,997,333 B2 * 8/2011 Angelle ..... E21B 19/07 166/77.52
8,511,246 B2 * 8/2013 Srinivasan ..... B63B 35/44 114/125
9,227,701 B2 * 1/2016 Woldring ..... B63B 21/20
9,315,242 B2 * 4/2016 Veselis ..... B63B 22/02
2006/0225891 A1 * 10/2006 Adams ..... E21B 19/002 166/382
2007/0296231 A1 * 12/2007 Borg ..... B65D 71/50 294/87.2
2008/0196882 A1 * 8/2008 McGuire ..... E21B 33/0422 166/85.1
2013/0075104 A1 3/2013 Hughes
2014/0169887 A1 * 6/2014 Garcia ..... E21B 19/004 405/224.4
2014/0262307 A1 * 9/2014 Caldwell ..... E21B 33/038 166/340

* cited by examiner

SEGMENTED GUIDE FUNNEL

BACKGROUND

This section is intended to introduce the reader to various aspects of art that may be related to various aspects of the present disclosure, which are described or claimed below. This discussion is believed to be helpful in providing the reader with background information to facilitate a better understanding of the various aspects of the present disclosure. Accordingly, it should be understood that these statements are to be read in this light, and not as admissions of prior art.

This disclosure relates to guide funnels used to guide a piece of subsea equipment for connection to a wellhead, a mating component of a subsea stack, or to a blowout preventer ("BOP") test stump.

Guide funnels are well-known in the art for guiding a piece of subsea equipment such as a BOP stack onto a wellhead. As the stack is landed, the guide funnel captures the wellhead and guides the stack along the funnel's taper until the wellhead and the connector are mated. Manufacturers and drilling operators also use guide funnels to guide a connector onto a mandrel.

Prior art guide funnels are single-body welded designs. This makes the funnels bulky, heavy, difficult to handle, and costly to make. Additionally, damage to any one part of the funnel may require complete replacement of the funnel. When used on a test stump, the stump's connector must be removed in order to install the funnel.

US 2013/0075104 A1 to Hughes discloses a guide funnel having a plurality of different diameter cylindrical sections which are aligned concentric with, and set inside, one another so that the funnel can be extended for use or collapsed for transport. While this funnel might be easier to handle in its collapsed state, the funnel is more complicated in design than the single piece funnels and shares those funnels' shortcomings in the other areas.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

A guide funnel made according to this disclosure is a segmented funnel that allows each segment to be spaced apart from an adjacent segment and individually connected on to a connector.

In an embodiment, the guide funnel includes segments that have a means of fastening to the connector or to each other. A funnel wall surface of the segment runs at an oblique angle between the bottom end of the segment and the inner circumferential edge of the top end of the segment.

The width of the funnel wall surface is sized so that, when the guide funnel is in an assembled state, a continuous or discontinuous funnel wall is formed between adjacent segments. To save weight a discontinuous funnel wall is formed.

The bottom end of the segment can include an arcuate-shaped ring segment that forms a portion of an outer periphery of the guide funnel. The arcuate-shaped ring segment is sized so that, when the guide funnel is in the assembled state, a continuous ring is formed at the bottom end of the assembled guide funnel. Alternatively, a continuous ring can be secured to the bottom end of the assembled funnel.

The top end of the segment can be sized so that, when the guide funnel is in the assembled state, the side of the top end abuts the side of an adjacent top end. The top end can include an adaptor ring secured to the inner circumferential edge of the top end. The adaptor ring, which can be temporarily attached to the segments, allows the same segments to provide a different size guide funnel depending upon the size of the ring used (e.g. 27 inch, 30 inch).

A method of guiding a piece of subsea equipment downwardly into an aligned position with a mating component includes forming a guide funnel by connecting a plurality of segments to the piece of subsea equipment. The segments each have a means of fastening to a connector. A funnel wall surface of the segment runs at an oblique angle between the bottom end of the segment and the inner circumferential edge of the top end of the segment. When assembled, a continuous or discontinuous funnel wall is formed between adjacent segments.

The system and method described in this disclosure provide a guide funnel that, compared to prior art guide funnels, weighs less, is less costly to manufacture and maintain, and is easier to install. Additionally, the connector does not have to be removed from the mandrel. The segments also provide a fixed height to the guide funnel, so there is no need for retaining means like in the prior art to lock the funnel into its extended state

Figure 1:
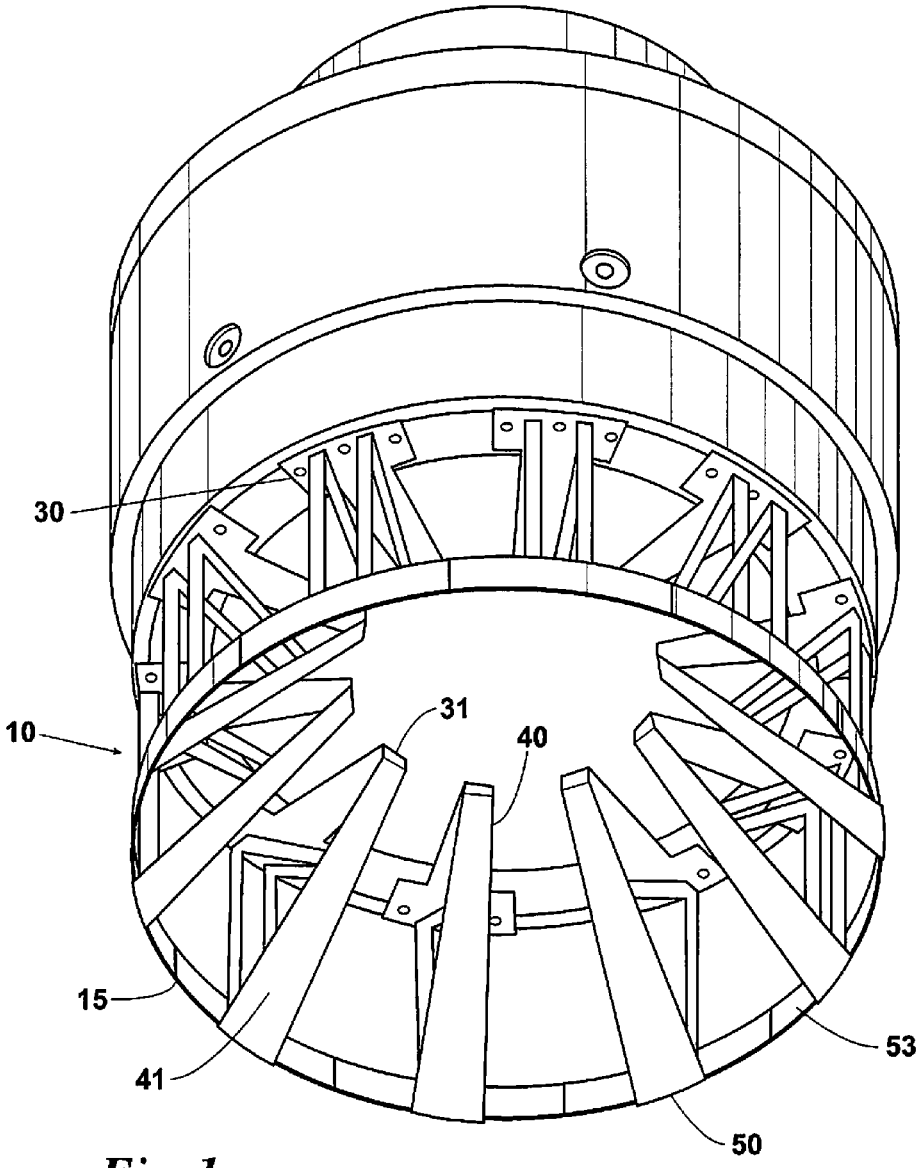
FIG. 1 is an isometric view of an embodiment of a segmented guide funnel in an assembled state and connected to a piece of subsea equipment.
Figure 2:
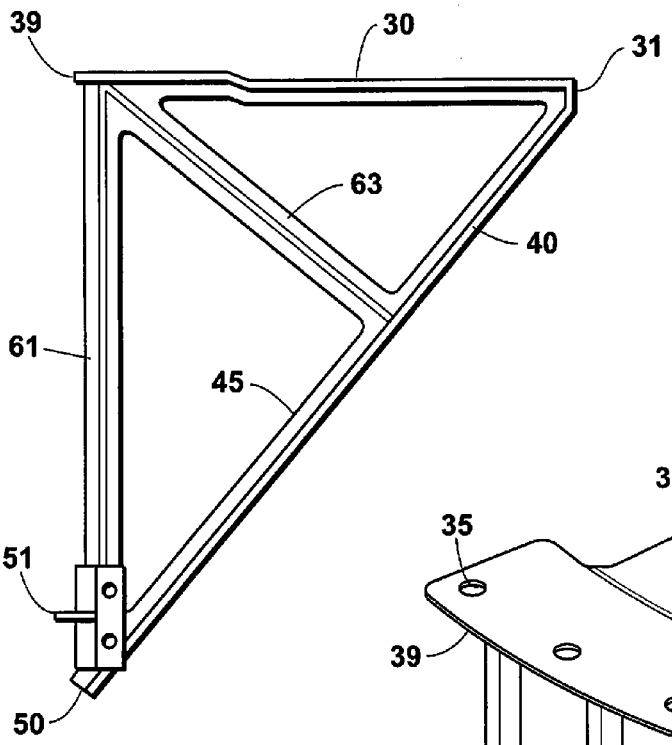
FIG. 2 is a side elevation view of a segment of the guide funnel of FIG. 1.
Figure 3:
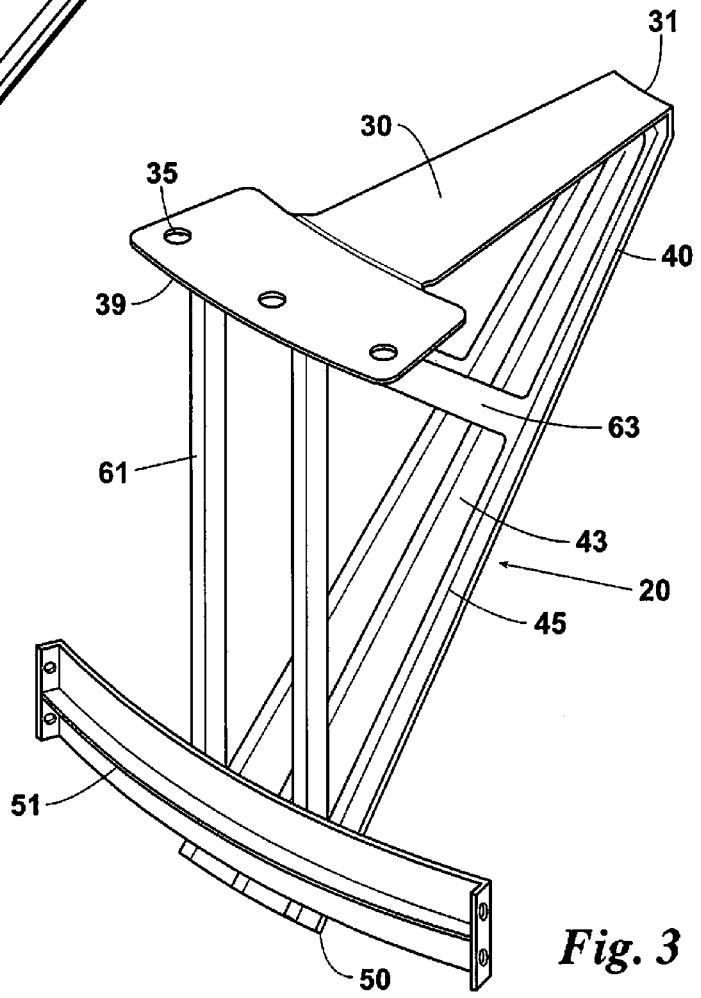
FIG. 3 is an isometric view of the segment of FIG. 2.
Figure 4:
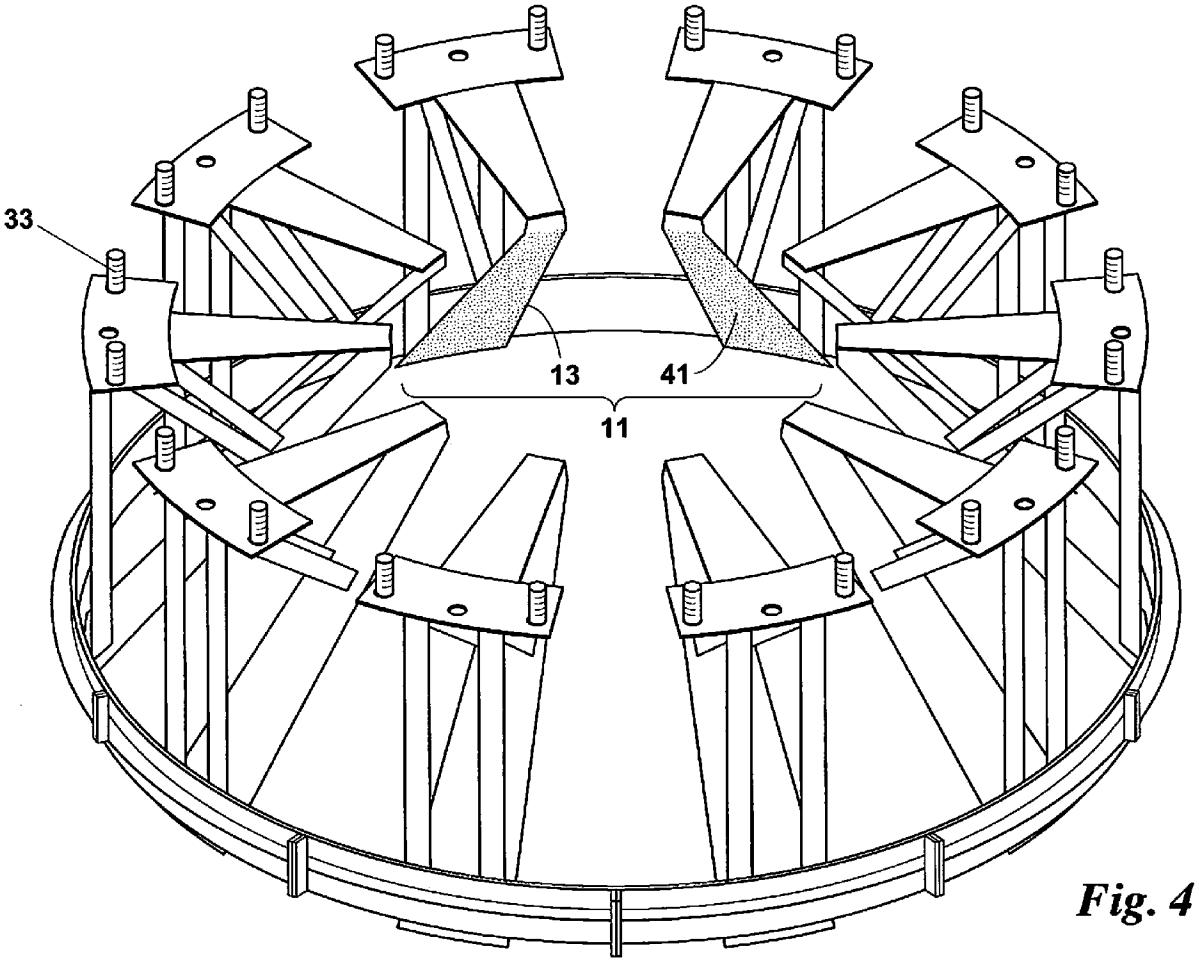
FIG. 4 is an isometric view of the guide funnel of FIG. 1.

The subject disclosure is further described in the following detailed description, and the accompanying drawing and schematic of non-limiting embodiment of the subject disclosure. The features depicted in the figure are not necessarily shown to scale. Certain features of the embodiments may be shown exaggerated in scale or in somewhat schematic form, and some details of elements may not be shown in the interest of clarity and conciseness.

ELEMENT NUMBERS AND ELEMENTS USED IN THE DRAWINGS AND DETAILED DESCRIPTION

10 Guide funnel
11 Funnel wall
13 Solid wall portion
15 Outer periphery
20 Segment
25 Adaptor ring
30 Top end
31 Inner circumferential (or peripheral) edge
32 Flange
33 Fastener or connector (fastening means)
35 Fastener hole (fastening means)
37 Side
39 Outer circumferential (or peripheral) edge
40 Funnel wall surface (forming a portion of 11)
41 Forward face
43 Rearward face
45 Rib
47 Plate
50 Bottom end
51 Arcuate-shaped ring segment
53 Continuous ring
61 Vertical support
63 Angled support

DETAILED DESCRIPTION

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Referring first to FIGS. 1 to 4, an embodiment of a segmented guide funnel 10 is made up of a plurality of segments 20 that, when connected to a piece of subsea equipment, collectively form a guide funnel 10. The segments 20 have a top end 30 for connection to a connector body and a funnel wall surface 40 (defined by the forward face 41) that runs at an oblique angle between a bottom end 50 of the segment 20 to an inner circumferential edge 31 of the top end 30.

A width "w" of the funnel wall surface 40, which can be tapered, can be sized to form a continuous or discontinuous funnel wall 11 in a circumferential direction between adjacent segments 20 when the guide funnel 10 is in the assembled state. The funnel wall surface 40 forms the solid wall portion 13 of the funnel wall 11.

The top end 30, which can be T-shaped, spans a distance between an arcuate inner circumferential edge 31 and an outer circumferential edge 39. At least one fastener (connector) 33 or fastener (connector) hole 35 is included.

Figure 5:
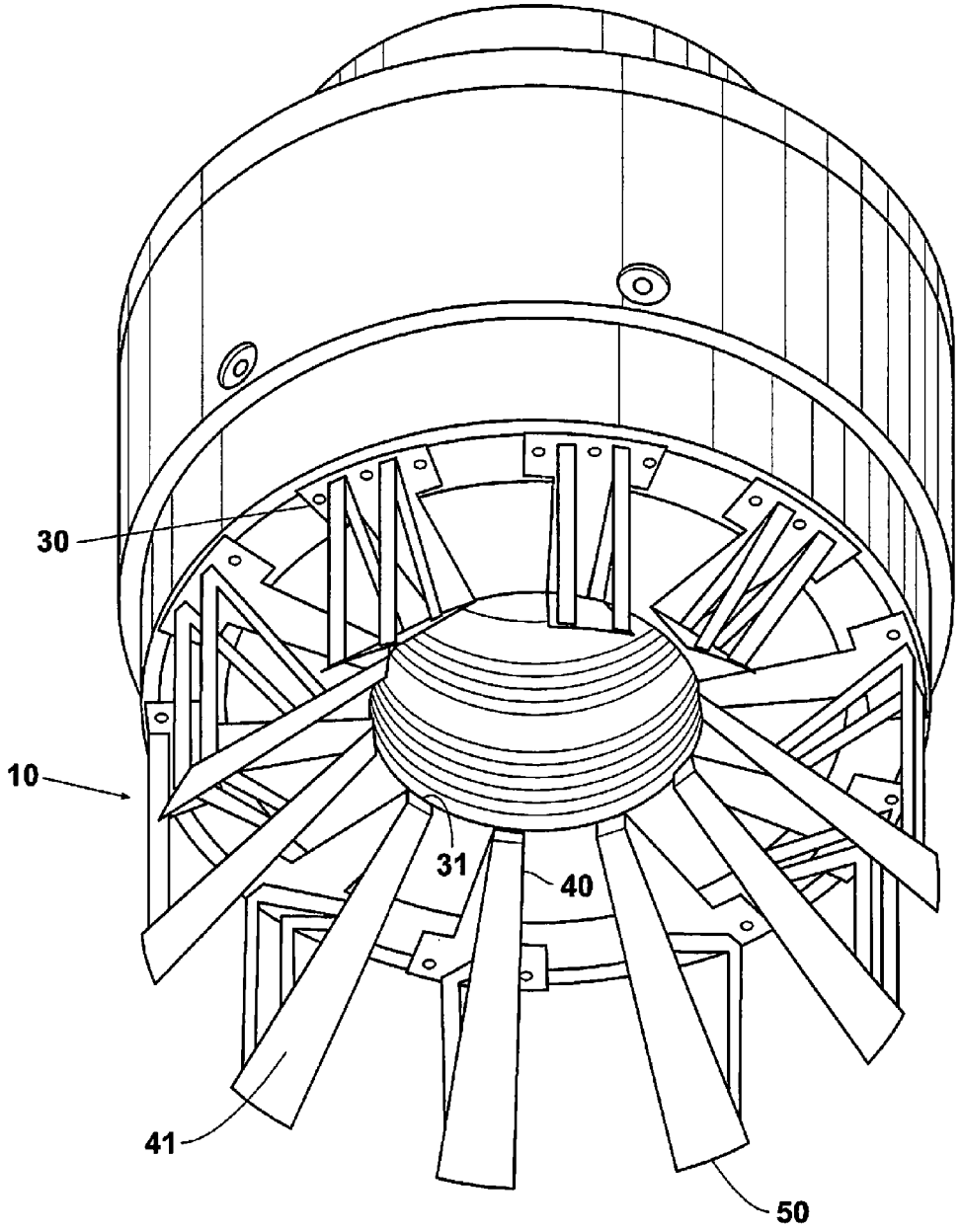
FIG. 5 is an isometric view of an embodiment of a segmented guide funnel in an assembled state and connected to a piece of subsea equipment.
Figure 9:
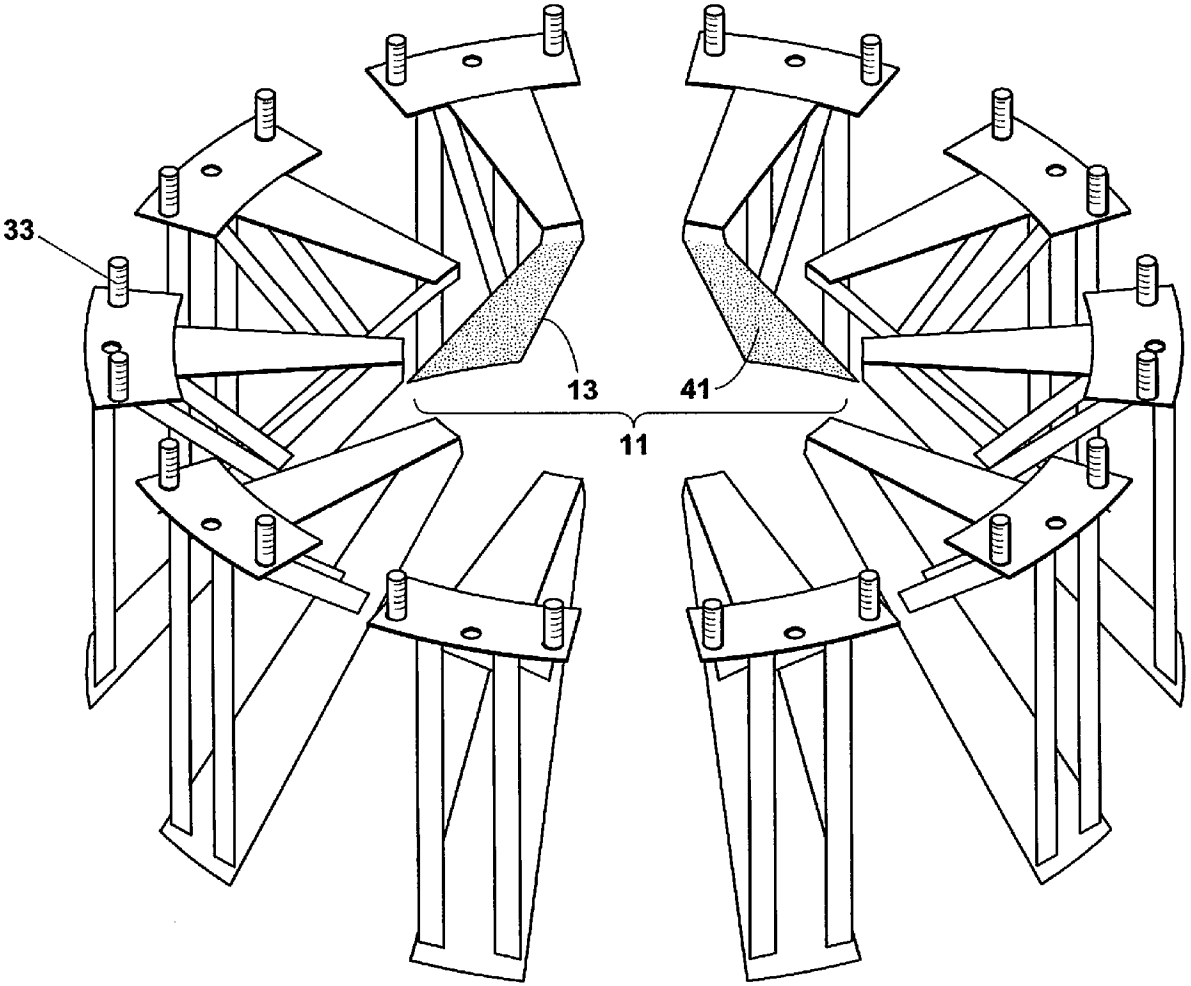
FIG. 9 is an isometric view of the guide funnel of FIG. 5 in an assembled state (but not attached to a connector).

The bottom end 50 includes an arcuate-shaped ring segment 51. The ring segment 51 is sized so that, when the guide funnel 10 is in its assembled state, a continuous ring 53 is formed along an outer periphery 15 of the guide funnel 10. Alternatively, the ring segment 51 can be excluded (see e.g. FIGS. 5 & 9).

One or more vertical supports 61, located toward the outer circumferential edge 39 of the top end 30, connect the top end 30 to the bottom end 50. At least one angled support 63 can also be provided to connect the top end 30 to a rearward face 43 of the funnel surface 40. The rearward face 43 of the funnel wall surface 40 can include ribs 45.

Figure 6:
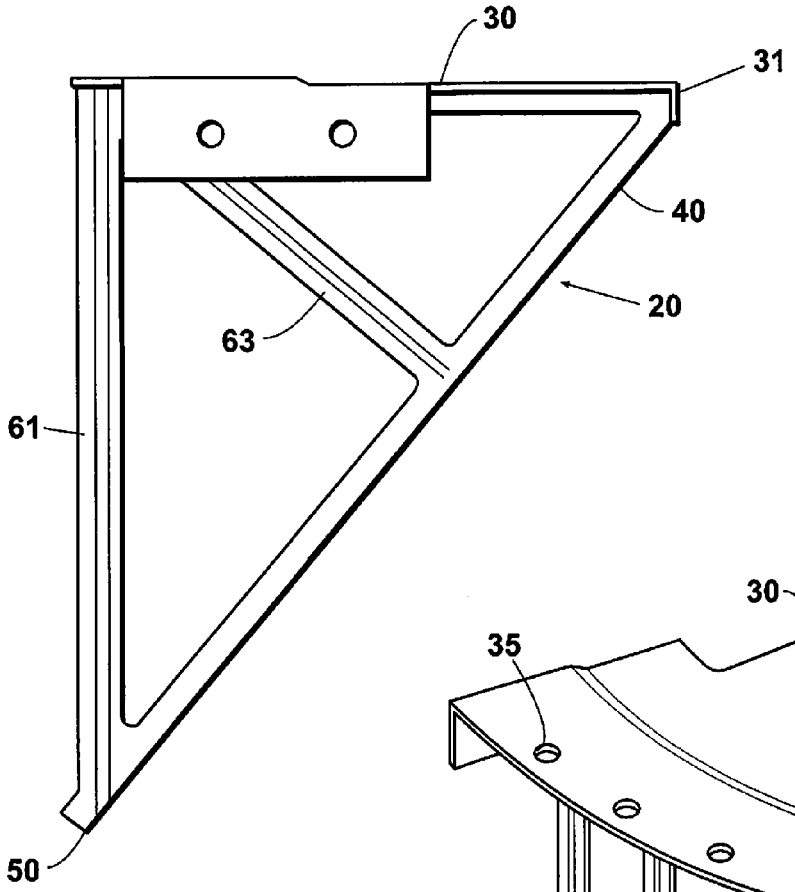
FIG. 6 is a side elevation view of a segment of the guide funnel of FIG. 8.
Figure 7:
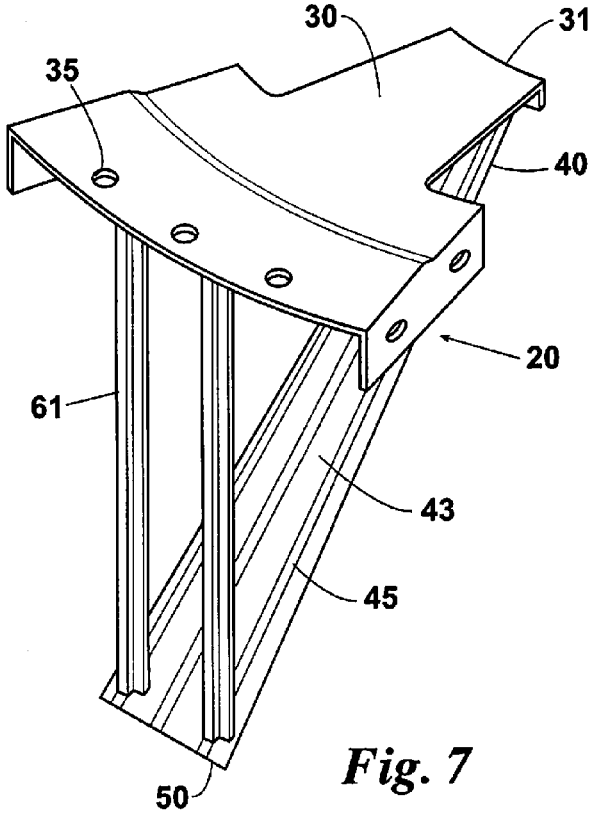
FIG. 7 is an isometric view of the segment of FIG. 6.
Figure 8:
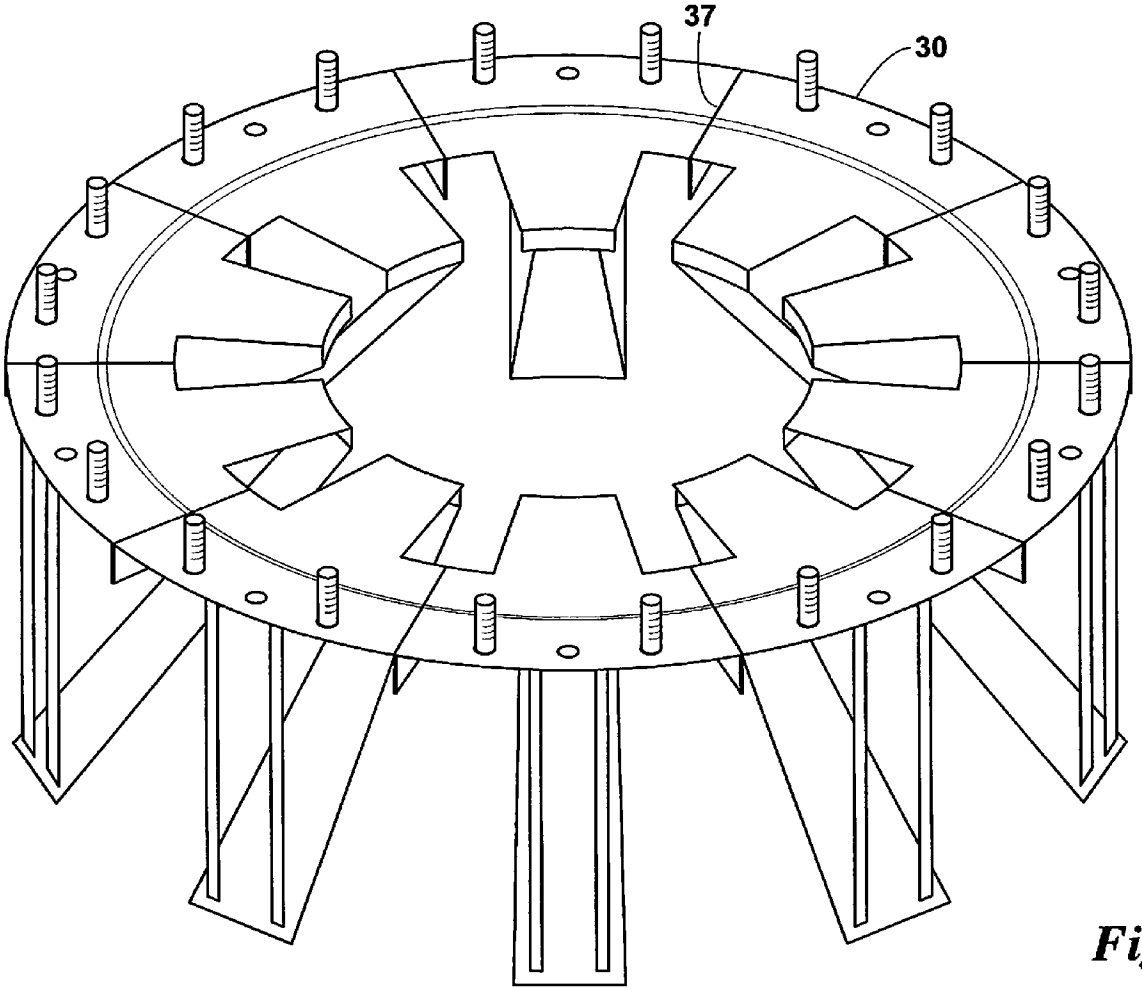
FIG. 8 is an isometric view of an embodiment of a segmented guide funnel in an assembled state (as if connected to a piece of subsea equipment).

Referring to FIGS. 6 to 8, an embodiment of the guide funnel 10 sizes the top end 30 so that when the guide funnel 10 is an assembled state, a side 37 of the top end 30 abuts an adjacent top end 30.

Figure 10:
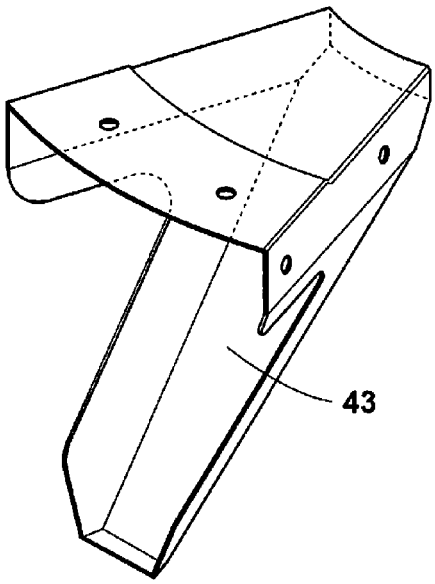
FIG. 10 is an isometric view of a section of the guide funnel of FIG. 11.
Figure 11:
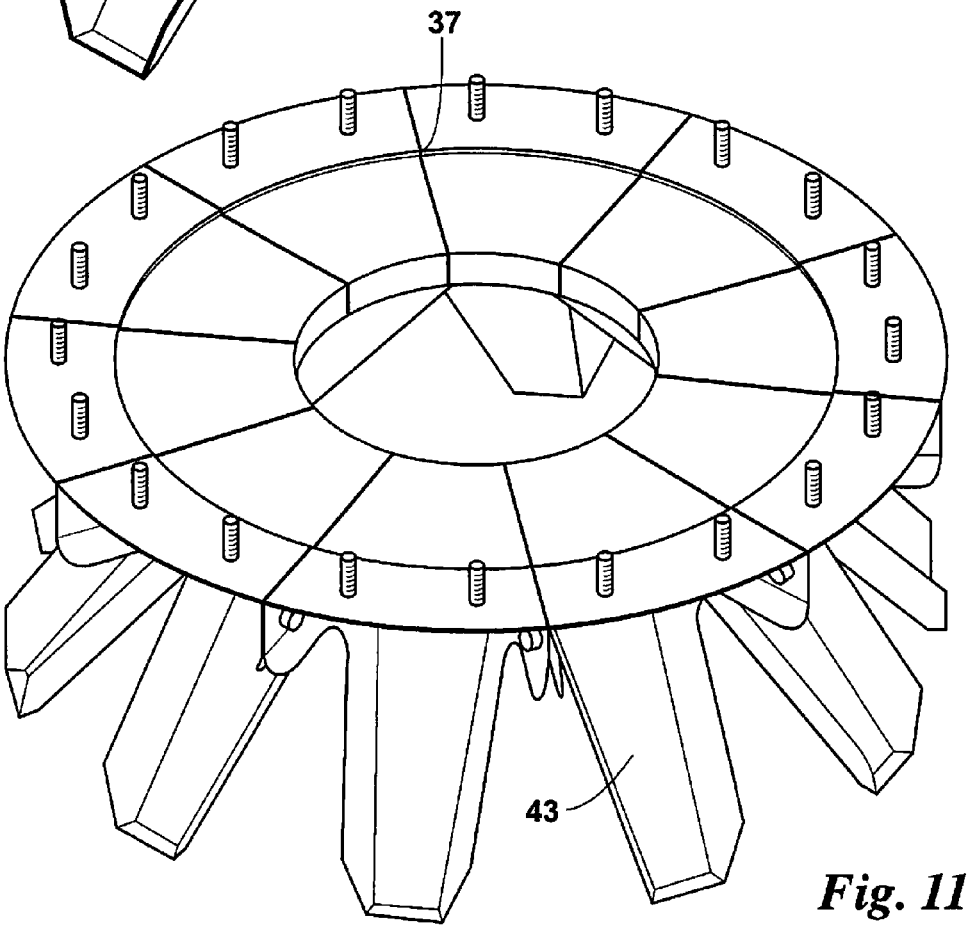
FIG. 11 is an isometric view of an embodiment of a segmented guide funnel in an assembled state.
Figure 12:
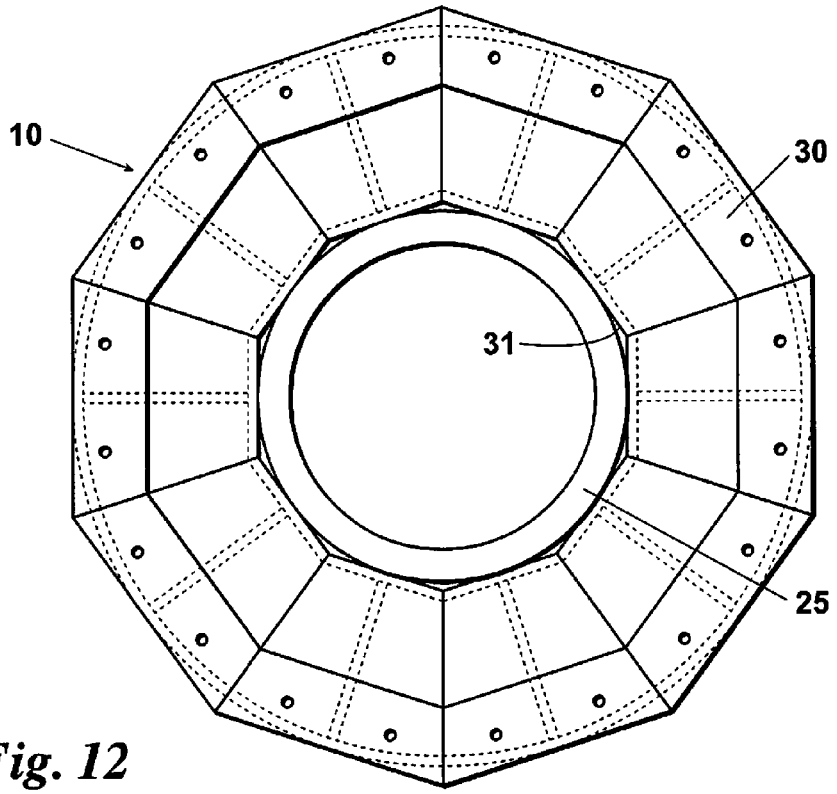
FIG. 12 is a top view of an embodiment of a segmented guide funnel in an assembled state.
Figure 13:
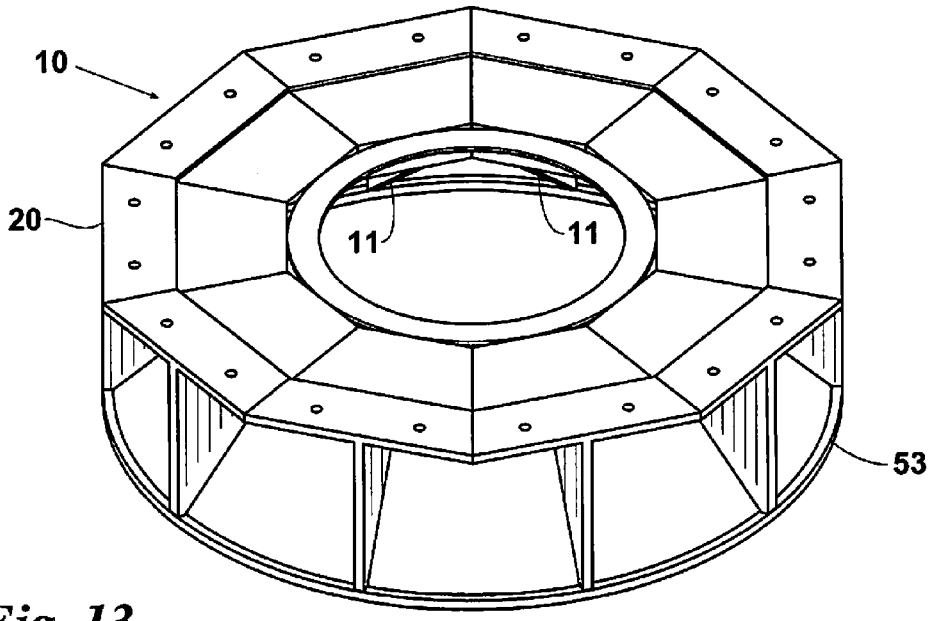
FIG. 13 is an isometric view of the guide funnel of FIG. 12
Figure 17:
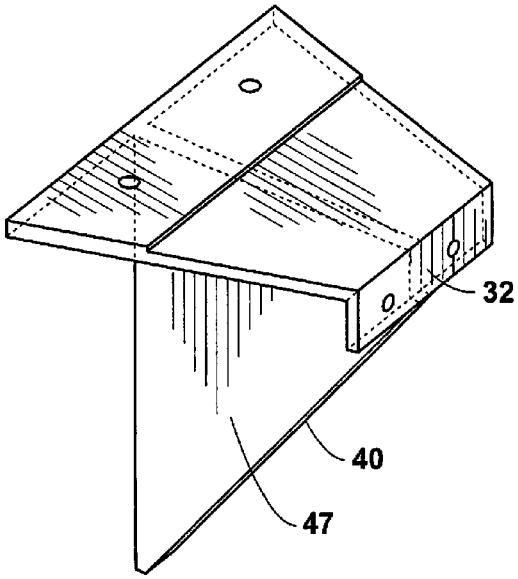
FIG. 17 is an isometric view of the segment of FIG. 14.
Figure 16:
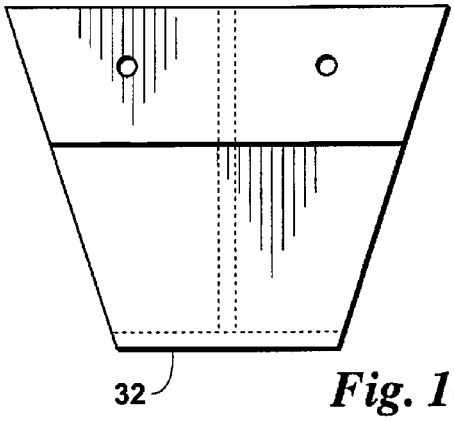
FIG. 16 is a top plan view of the segment of FIG. 14.
Figure 15:
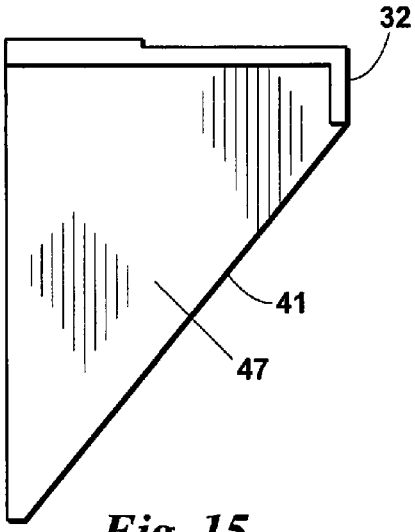
FIG. 15 is a side elevation view of the segment of FIG. 14.
Figure 14:
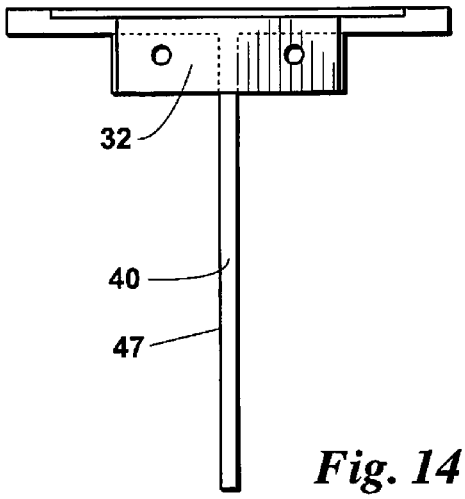
FIG. 14 is a front elevation view of a segment of the guide funnel of FIG. 12.

Referring to FIGS. 10 and 11, an embodiment of the guide funnel 10 includes a trapezoidal-shaped top end 30 sized to that its sides 37 abut an adjacent top end 30. The rearward face 43 of the funnel wall surface 40 is concave-shaped.

Referring to FIGS. 12 to 17, an embodiment of the guide funnel 10 includes a trapezoidal-shaped top end 30 sized to abut an adjacent top end 30 when the funnel 10 is in an assembled state. A forward face 41 of a triangular-shaped plate 47 forms the funnel wall surface 40. Collectively, the segments 20 form a discontinuous funnel wall 11 in a circumferential direction between adjacent segments 20 when in the assembled state.

A continuous ring 53 can be attached to the bottom end 50 of the assembled segments 20. At the top end 30, an adaptor ring 25 can be attached to the inner circumferential edge 31 of the segments 20. By using a different size adaptor ring 25, the same segments 20 provide different size guide funnel 10 (e.g. 27 inch, 30 inch). A flange 32 located at the inner circumferential edge 31 of the top end 21 provides means to connect the segment 20 to the ring 25. Compared to a single body design, the segmented guide funnel can provide weight reduction.

The segments 20 of the various embodiments can be made out of a plastic via injection molding, made out of a single sheet of metal by folding, or by forging, thereby reducing or eliminating the need for welds.

A method of guiding a piece of subsea equipment downwardly into an aligned position with a wellhead, mating component, or a test stump, includes forming a guide funnel 10 which has a discontinuous funnel wall 11 by connecting a plurality of segments 20 to the piece of subsea equipment.

The disclosure may be susceptible to various modifications and alternative forms, embodiment have been shown by way of example in the drawing and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A guide funnel comprising:

a plurality of segments, each segment of the plurality having at a top end of the segment a means for fastening to a piece of subsea equipment being guided, and a funnel wall surface running inwardly and upwardly at an oblique angle over an entire distance between a bottom end of the segment and an inner circumferential edge of the top end of the segment, a width of the funnel wall surface sized so that, when the guide funnel is in an assembled state, a spaced-apart funnel wall is formed between adjacent segments of the plurality of segments.

2. A guide funnel according to claim 1 further comprising the width of the funnel wall surface being tapered along its length.

3. A guide funnel according to claim 1 further comprising the bottom end including an arcuate-shaped ring segment, the arcuate-shaped ring segment forming a portion of an outer periphery of the guide funnel when in the assembled state.

4. A guide funnel according to claim 1 further comprising a ring connected to a bottom end of the guide funnel and forming a portion of an outer periphery of the guide funnel when in the assembled state.

5. A guide funnel according to claim 1 further comprising an adaptor ring connected to a top end of the guide funnel when in the assembled state.

6. A guide funnel according to claim 1 further comprising the top end sized so that, when the guide funnel is in the assembled state, a side of the top end abuts to a side of an adjacent top end.

7. A guide funnel according to claim 1 further comprising the funnel wall surface being formed by a face surface of a triangular-shaped plate.

8. A guide funnel according to claim 7 wherein the triangular-shaped plate forms a vertical support of the funnel segment.

9. A guide funnel according to claim 1 further comprising at least one vertical support located toward an outer circumferential edge of the top end and connecting the top end to the bottom end.

10. A guide funnel according to claim 1 further comprising at least one angled support connecting the top end to the funnel surface.

11. A guide funnel according to claim 1 further comprising the funnel wall surface including at least one rib running along a portion of its length.

12. A guide funnel according to claim 1 further comprising a rearward face of the funnel surface being concave-shaped.

13. A method of guiding a piece of subsea equipment downwardly into an aligned position with a mating component, the method comprising:

forming a guide funnel by connecting a plurality of segments to the piece of subsea equipment;

wherein the segments each have at a top end a means for fastening to the piece of subsea equipment and a funnel wall surface running at an oblique angle inward over an entire distance between a bottom end of the segment and an inner circumferential edge of the top end of the segment; and wherein a spaced-apart funnel wall is formed between adjacent segments of the plurality of segments.

14. A method according to claim 13 further comprising securing a first adaptor ring to the inner circumferential edge of the top end.

15. A method according to claim 14 further comprising:

disconnecting the first adaptor ring from the inner circumferential edge of the top end; and securing a second adaptor ring to the inner circumferential edge of the top end;

the second adaptor ring having a different size diameter than that of the first adaptor ring.

16. A guide funnel for use in guiding a piece of subsea equipment downwardly into mating alignment, the guide funnel comprising:

a plurality of segments, each segment of the plurality of segments including a funnel wall surface extending inwardly and upwardly at an oblique angle over an entire distance from a bottom end of the segment to a top end of the segment;

the plurality of fixed segments forming a spaced-apart funnel wall when the guide funnel is in an assembled state;

further comprising means for fastening the piece of subsea equipment to each segment, the means for fastening being located at the top end.

17. A guide funnel according to claim 16 further comprising the plurality of segments being spaced-apart from one another.

18. A guide funnel according to claim 16 further comprising a first adaptor ring and a second adaptor ring, the first and second adaptor rings having a different diameter.

19. A guide funnel comprising:

a plurality of segments, each segment of the plurality having at a top end of the segment a means for fastening to a piece of subsea equipment being guided, and a funnel wall surface running inwardly and upwardly at an oblique angle between a bottom end of the segment and an inner circumferential edge of the top end of the segment, and at least one angled support connecting the top end of the segment to the funnel wall surface, a width of the funnel wall surface sized so that, when the guide funnel is in an assembled state, a spaced-apart funnel wall is formed between adjacent segments of the plurality of segments.

* * * * *